United States Patent [19]

Donahue

[11] 4,304,074

[45] Dec. 8, 1981

[54] PREFABRICATED ROOF TRUSS ASSEMBLY FOR STRUCTURALLY JOINED MODULAR BUILDINGS WITH LATERALLY OFFSET RIDGE LINES

[76] Inventor: Daniel J. Donahue, Freeman's Point, P. O. Box 1138, Portsmouth, N.H. 03801

[21] Appl. No.: 108,626

[22] Filed: Dec. 31, 1979

[51] Int. Cl.[3] ..... E04B 7/02

[52] U.S. Cl. ..... 52/92; 52/639

[58] Field of Search ..... 52/90, 92, 93, 641, 52/66, 639

[56] References Cited

U.S. PATENT DOCUMENTS

| | | | |
|---|---|---|---|
| 3,404,496 | 10/1968 | Ballard | 52/641 |
| 3,479,783 | 11/1969 | Tureit | 52/641 |
| 3,699,731 | 10/1972 | Arnold | 52/92 |
| 3,701,225 | 10/1972 | Perry | 52/641 |
| 3,727,354 | 4/1973 | Powell | 52/641 |

FOREIGN PATENT DOCUMENTS

| | | | |
|---|---|---|---|
| 166277 | 2/1959 | Sweden | 52/92 |

*Primary Examiner*—Price C. Faw, Jr.
*Assistant Examiner*—Henry E. Raduazo
*Attorney, Agent, or Firm*—Sughrue, Mion, Zinn, Macpeak and Seas

[57] ABSTRACT

Abutting prefabricated roof truss sections have equal length inclined roof rafter members but have ceiling joist members of different longer length. The bearing beam member for the section having the longer ceiling joist is inclined with and connected at its ends to the end of its ceiling joist member and the rafter member adjacent areas of contact with the corresponding rafter and ceiling joist members of the abutting sections. This permits a symmetrical roof for a building structure whose vertical interior load bearing walls are offset laterally to form rooms of different lateral width.

2 Claims, 2 Drawing Figures

PREFABRICATED ROOF TRUSS ASSEMBLY FOR STRUCTURALLY JOINED MODULAR BUILDINGS WITH LATERALLY OFFSET RIDGE LINES

FIELD OF THE INVENTION

This invention relates to modular housing and, more particularly, to prefabricated roof truss assemblies comprising laterally end abutting prefabricated roof truss sections.

BACKGROUND OF THE INVENTION

In the prefabricated, sectional modular home construction, attempts have been made to reduce labor costs, to speed construction, and to permit the building construction to be achieved using a minimal amount of skilled labor. Over the years, rather than building the roof structure from stick lumber, conventionally both in the modular home and in the stick built construction field, prefabricated roof trusses of generally triangular shape and of open, wooden framework have been factory built to given dimensions and are lifted onto the vertical sidewalls of a building or building section. Under such conditions, the roof framework can be completed within the day. This is just as true for modular homes built in the factory and transported by way of section to the erection site. Particularly, in the modular home field, standard room dimensions, building length and width dimensions have involved, for instance, the front to back section joined modular home. Conventionally, the sections are of equal width which may be twelve feet, fourteen feet, sixteen feet, etc., with the vertical bearing walls normally designated "marriage walls" being joined on site. Further, the ends of abutting roof truss sections whose abutting ends define the ridge line are similarly joined on site.

Conventionally, such roof truss sections are right triangular in shape, including horizontally extending ceiling joist members of a length corresponding to the room width (as defined by the marriage walls). The truss sections ceiling joist members bear at one end the lower end of an inclined roof rafter member, while at the other end, they have fixed thereto the upright, vertical stud or bearing beam members, which in turn have their opposite ends fixed to the upper end of the inclined rafter member. Intermediate of the ends of the ceiling joist member, there is normally provided a vertical riser which is fixed, at its bottom, to the ceiling joist member and, at its top, to the rafter member intermediate of the rafter member ends. Further, an inclined strut is normally affixed at one end to the area of joint between the mid-frame riser and the roof rafter member and at its opposite end is fixed to the ceiling joist member adjacent the connection of that joist member to the bearing beam member. Such construction is standard and produces a modular sectionally joined home of total symmetrical configuration. That is, the building roof ridge line is centered with respect to the center line of the building. The room sizes at least in terms of the load bearing marriage walls are standard and equal for the two modular sections front-to-back joined and the bearing walls readily support and are in line with the ridge pole and the bearing members of the multiple longitudinally spaced roof truss assemblies spanning the vertical walls of the modular home.

SUMMARY OF THE INVENTION

The present invention provides an improved multi-section prefabricated roof truss assembly which provides a ridge line which is offset relative to the bearing walls of the fabricated structure and in which room widths as determined by the load bearing walls may be different for the two front and rear sections of the building structure. The roof truss assembly of the present invention permits a prefabricated building to be constructed of back-to-back joined sections where the overall width of the sectional home is intermediate in size, that is, of a different width from that normally achieved in modular buildings, while utilizing conventional but different width modular wall frame sections.

The invention constitutes a roof truss assembly which comprises end abutting prefabricated roof truss sections wherein each section includes a horizontal ceiling joist member, an inclined roof rafter member fixed at one end to one end of the ceiling joist member remote from the line of abutment with the other section, and extending obliquely upwardly therefrom. A load bearing beam member is fixed at the other end of the ceiling joist member and is fixed to the inclined overlying roof rafter member. The improvement resides in both the rafter members being of equal length with ceiling joist members being of different length, one normally that of its shorter rafter member and the ceiling joist member of the other section being of longer length than its rafter member.

Further, the bearing beam member for said one section inclines from the vertical and is connected at one end to the end of the ceiling joist member and at its opposite end to the end of the rafter member. For the other section, the bearing beam member extends vertically upwardly from the end of its ceiling joist member and is fixed at its opposite end to the rafter member but short of the end of that rafter member. When the roof truss sections are end joined to each other at the bottom ends of the bearing beams, the ridge line as defined by the near abutting ends of the rafters, is laterally offset from the common bearing load line defined by the abutting ends of the ceiling joist members of the roof truss sections and by the underlying bearing walls of that portion of the building structure supporting the roof.

DESCRIPTION OF THE PREFERRED EMBODIMENT

Figure 1:
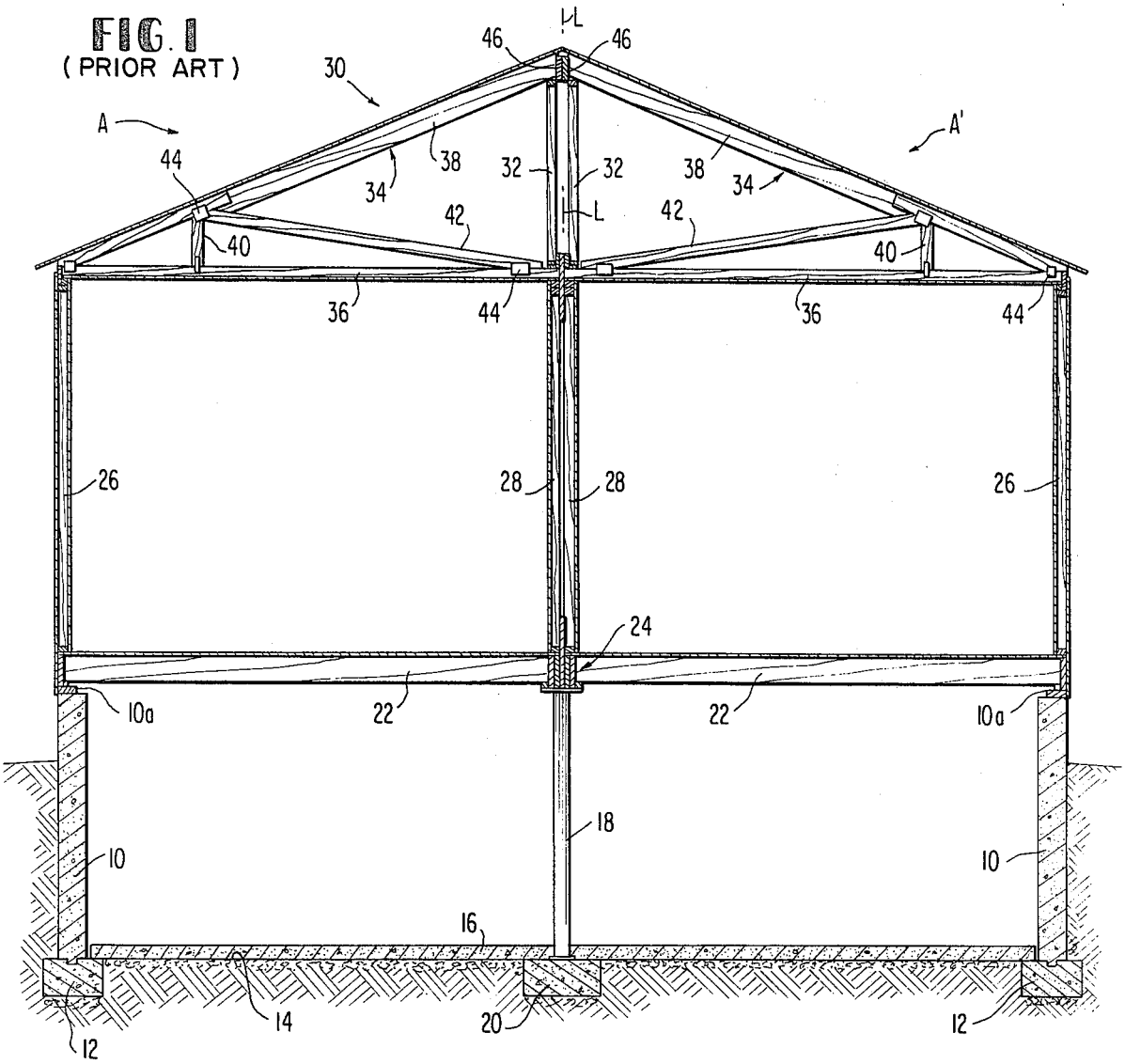
FIG. 1 (PRIOR ART)
FIG. 1 is a vertical sectional view of a prior art type modular building structure constructed of back-to-back abutting and joined sections having a sectional roof truss assembly whose ridge line is centered with respect to the vertical bearing walls of the underlying building structure.
Figure 2:
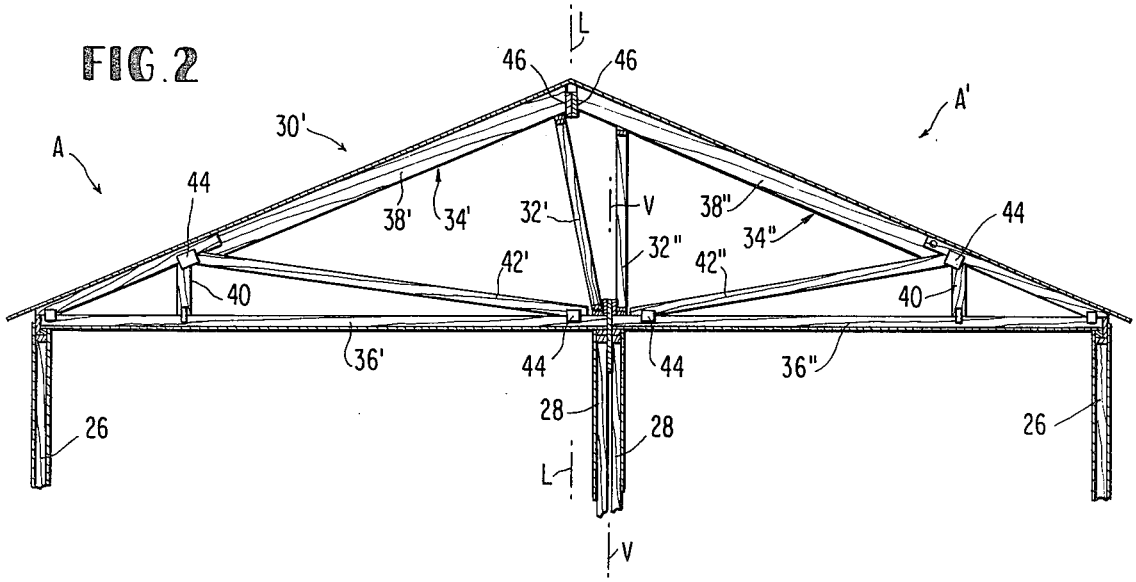
FIG. 2 is a vertical sectional view of a modular building structure employing the improved offset ridge line type sectional roof truss assembly forming one embodiment of the present invention.

Prior to referring to FIG. 2, which illustrates in a preferred form an embodiment of the present invention, reference may be had to FIG. 1 which illustrates the prior art type modular home sections as at A, A′ to the left and right, respectively, which are essentially mirror images of each other, in terms of width and location of bearing walls and resulting roof ridge line created by the utilization of prefabricated roof truss assembly sections which are end-to-end abutted and joined.

Specifically, each modular home section is adapted to be placed in position on a preformed foundation, formed typically, for instance, of concrete walls as at 10 rising vertically from footings 12 and within an excavation 14. There may be provided a concrete slab 16. Since the modular home is formed in two sections, necessarily lolly columns as at 18 are provided along the longitudinal center line of the building. Lally columns 18 extend upwardly from lolly column footings 20. Longitudinally spaced and laterally extending floor trusses 22 are provided which extend from the sills 10*a* above the concrete foundation wall 10 to longitudinally extending girders indicated generally at 24, all of which is conventional.

Such modular units are constructed with an exterior wall along one side as at 26 and on the opposite side an internal marriage wall as at 28 which rises from the longitudinally extending girder and is in line with the lally columns 18 employed in supporting the longitudinal girder structure 24. As may be appreciated, therefore, for each of the sections A and A', the vertical walls 26 and 28 are load bearing walls and, as such, bear the roof structure indicated generally at 30. The roof structure 30, in turn, is wholly preconstructed and, as a roofing half, is integral with the building section as at A, A', and is also joined at the vertical marriage walls 28 for the individual sections.

Typically, as shown, such a building sectional structure employs a plurality of preformed roof truss assembly sections indicated generally at 34, each being comprised basically of a vertical bearing beam 32, a horizontal ceiling joist member 36, and an inclined rafter member 38. The rafter member 38 is joined at one end to an end of the ceiling joist member 36 and is joined, at its opposite end, to the bearing beam member 32.

To stabilize this open framework, additional members are employed. Typically, for instance, a midframe riser 40 rises vertically from the ceiling joist member 36 and is fixed at respective ends to the roof rafter member 38 and to the ceiling joist member 36. Further, an inclined reinforcing strut 42 is fixedly connected at one end to the rafter member 38 adjacent the area where the riser 40 contacts that member on its opposite end to the ceiling joist member adjacent the connection between that member and its bearing beam member 32.

As shown, the mechanical fixing of these members, which are normally of wood and may comprise 2×4's, 2×6's, 2×8's or the like, is achieved by the use of plates as at 44, through which nails, bolts or staples extend to mechanically lock the members together in a structural assembly. Longitudinally extending members may be employed for joining the various longitudinally spaced roof truss assemblies to each other, as for instance by the use of ridge beams or poles. Initially, each ridge beam 46 is fixed to its modular building section as A, A', and these are nailed or otherwise joined to each other on site, when the two sections are back-to-back joined after being placed on the preformed foundation.

As may be appreciated, in the illustrated modular building of FIG. 1, the roof sizes are set and uniform, at least in terms of the bearing walls 28 for the sections. Typically, the modular home sections may be of twelve feet, fourteen feet, sixteen feet, etc., in width. Total symmetry is assured with the ridge line in line with the bearing marriage walls 28 which are also joined together mechanically during on site assembly of the sections. In the past, by employing duplicate identically sized and essentially mirror image sections, results in complete uniformity. With the sections in twelve, fourteen, and sixteen foot widths, the resulting complete two section modular building structure is twenty-four feet in width, twenty-eight feet in width, or thirty-two feet in width.

Referring to FIG. 2 of the drawings, there is shown a modular building construction such as modular house similar to that of FIG. 1. However, it incorporates the improved end abutting sectional roof truss assemblies of the present invention. In this case, the building has symmetry but the ridge line is laterally offset with respect to the interior bearing walls, as defined in this case by the marriage walls 28 of the two building sections A, A', which are back-to back, abutting and joined. It should be noted that the present invention has equal applicability to a stick built home where the roof trusses are formed of prefabricated sections which are end-to-end joined and are mounted in longitudinally spaced parallel fashion over the length of the building after the stick walls are in place, the building framing is completed by framing out the roof structure. In FIG. 2, which constitutes a preferred embodiment of the invention, like elements to the prior art structure of FIG. 1 bear like numerical designations. In that respect, instead of mirror image and roof truss sections, there is provided a left roof truss section as at 34' and a right roof truss section 34'' for each roof truss assembly. Of course, the roof is also sectionalized and, in fact, travels with the modular home section A and A' in the same manner as the prior art described previously. Looking to the left roof truss assembly section 34', instead of having ceiling joist members which are equal in length, section 34' has a ceiling joist member 36' which is longer than that of the corresponding right section 34'' rafter 38'. In terms of the overall length of the section as determined by the length of the ceiling joist member 36', the roof rafter member 38' terminates short of the right end of that joist member 36'. The riser 40 is equally sized to that of the prior art, but the strut 42' is in this case a little longer than is the corresponding strut 42' in the end abutting section 34'' to the right. Stapled plates 44 may be employed in connecting these wooden members together to form each section. In contrast to the prior art structure, the bearing beam member 32' of section 34' does not extend vertically, but in fact is inclined away from the vertical so as to underlie and be joined to the end of the rafter member 38'. To the end of that rafter member 38' is provided a ridge pole or beam 46 which is laterally offset from a vertical load bearing line as indicated at V, and which passes through the plane as defined by the end of the sealing joist member 36'.

In the illustrated embodiment, the roof truss section 34' may be approximately fourteen feet in length with a one foot lateral offset for ridge line L, as defined by the exterior surface of the ridge beam or pole 46.

Referring to the right section 34'' of the roof truss assembly 30', it is noted that the ceiling joist member 36'' of that section is shorter than the ceiling joist member 36' of section 34'. Further, the rafter member 38'' of section 34'' is equal in length to the rafter member 38' of section 34' such that the end remote from the eave in this section overhangs the vertical center line V by a distance of one foot corresponding to the one foot lateral offset for the ridge line as defined by ridge beam 46 of roof truss assembly section 34'. The ridge beam 46 of both sections 34' and 34'' abut each other such that the ridge line L is laterally offset from the bearing line V, as defined by the abutting ends of the ceiling joist members 36' and 36'' of respective sections. In that respect, the load at the load line V is transmitted obliquely from the roof for section 34' by way of the inclined bearing beam member 32', while for the roof of the building defined by roof truss sections 38, 34'', the roof load near the center of the roof is transmitted vertically through the vertical bearing beam 32'' for that section to its marriage wall 28.

Inclined strut 42' is shorter than strut 42 of section 34, while the mid-frame risers 40 are equal in length, position and function for both sections 34' and 34''.

While the invention has been particularly shown and described with reference to a preferred embodiment thereof, it will be understood by those skilled in the art that various changes in form and details may be made therein without departing from the spirit and scope of the invention.

What is claimed is:

1. In a roof truss assembly comprising end abutting roof truss sections, each section including a horizontal ceiling joist member, an inclined roof rafter member fixed at one end to an end of said ceiling joist member remote from the abuttment end of said roof truss section with said other section, said roof rafter member extending obliquely upwardly and away from said ceiling joist member, and a bearing beam fixed at one end to the other end of said ceiling joist member and being fixed at its other end to said inclined overlying roof rafter member, said ceiling joist members for abutting roof truss sections being in horizontal, end abutting position, and said abutting roof truss sections being supported by vertical sidewalls underlying respective non-abutting ends of said ceiling joist members, and a common interior load bearing vertical wall underlying the abutting ends of said horizontal ceiling joist members of said abutting roof truss sections, the improvement wherein:

both rafters are of equal length, the ceiling joist member of one section is longer than the ceiling joist member of said other section, said bearing beam member of said one section is inclined from the vertical to connect at one end to the end of the ceiling joist member and at the other end to the end of the rafter member such that the ridge line defined by the ends of said rafter members is laterally offset from a common bearing line defined by the abutting ends of said ceiling joist members when said sections are end-to-end abuttingly joined, thereby providing to a building structure a symmetrical roof line while providing the interior load bearing wall offset with respect to the building longitudinal center line.

2. The roof truss assembly as claimed in claim 1, wherein said bearing beam for said other roof truss section is fixed at one end to the end of the ceiling joist member of said other section and extends vertically upwardly therefrom, and wherein the opposite end of said vertical bearing beam is fixed to the under side of said ceiling joist member intermediate of the ends of that member such that a portion of said inclined roof rafter member of said other section overhangs the bearing line of said other roof truss section as defined by the end of said ceiling joist member and said vertical bearing beam member.

* * * * *